US006766541B2

(12) United States Patent
Adams et al.

(10) Patent No.: US 6,766,541 B2
(45) Date of Patent: Jul. 27, 2004

(54) JOINT FOR A PORTABLE RESTROOM

(75) Inventors: Reginald Ellis Adams, Muskegon, MI (US); Daniel Scott Sommerfeld, Kalamazoo, MI (US); David Joseph Harris, Muskegon, MI (US); William Jay Kelley, St. Hart, MI (US)

(73) Assignee: Five Peaks Technology, Muskegon, MI (US)

( * ) Notice: Subject to any disclaimer, the term of this patent is extended or adjusted under 35 U.S.C. 154(b) by 0 days.

(21) Appl. No.: 10/300,290

(22) Filed: Nov. 20, 2002

(65) Prior Publication Data

US 2004/0093664 A1 May 20, 2004

(51) Int. Cl.[7] ..... A47K 11/02
(52) U.S. Cl. ..... 4/449; 4/476; 52/280
(58) Field of Search ..... 4/449, 460, 476; 52/281, 282.1, 282.4, 282.5, 285.3, 280

(56) References Cited

U.S. PATENT DOCUMENTS 2,126,499 A * 8/1938 Petersen ..... 52/461
2,364,083 A * 12/1944 Lindsay ..... 52/280
3,226,008 A * 12/1965 Chiorri ..... 229/198.1
5,038,535 A * 8/1991 Van Praag, III ..... 52/127.9
6,418,672 B1 7/2002 Hampel
6,427,256 B1 * 8/2002 Mullett et al. ..... 4/476

FOREIGN PATENT DOCUMENTS

GB 2037583 * 7/1980

* cited by examiner

*Primary Examiner*—Charles E. Phillips
(74) *Attorney, Agent, or Firm*—Brinks Hofer Gilson & Lione; Raymond J. Vivacqua

(57) ABSTRACT

In a preferred embodiment, a joint for joining a first panel and a second panel of a portable restroom includes a first jaw section, a second jaw section, and an outer bumper section. The first jaw section is adapted to allow insertion and removal of the first panel along a first axis and to provide engagement to the first panel in all directions perpendicular to the first axis. The second jaw section is adapted to allow insertion and removal of the second panel along a second axis and to provide engagement to the second panel in all directions perpendicular to the second axis. The outer bumper section has a first edge connected to the first jaw section and a second edge connected to the second jaw section.

17 Claims, 4 Drawing Sheets

JOINT FOR A PORTABLE RESTROOM

TECHNICAL FIELD

This invention relates generally to the portable restroom field, and more specifically to an improved joint for joining two panels of a portable restroom.

BACKGROUND

Portable restrooms mainly function to temporarily increase the availability of restrooms during a large public event or during a building renovation. These restrooms are typically brought to the site of the event or renovation strapped to a flat truck bed. The transportation of the portable restrooms often causes scratches and mars on the corners of the portable restrooms. In extreme cases, the transportation may cause structural failure of the corners of the portable restrooms. Since corners of a portable restroom are typically riveted to the panels, a structural failure of the corner renders the entire portable restroom useless.

For these reasons, there is a need in the art of portable restrooms to create an improved joint for joining two panels of a portable restroom. This invention provides such joint.

DESCRIPTION OF THE PREFERRED EMBODIMENT

The following description of the preferred embodiment of the invention is not intended to limit the invention to this preferred embodiment, but rather to enable any person skilled in the art of portable restrooms to make and use this invention.

Figure 1:
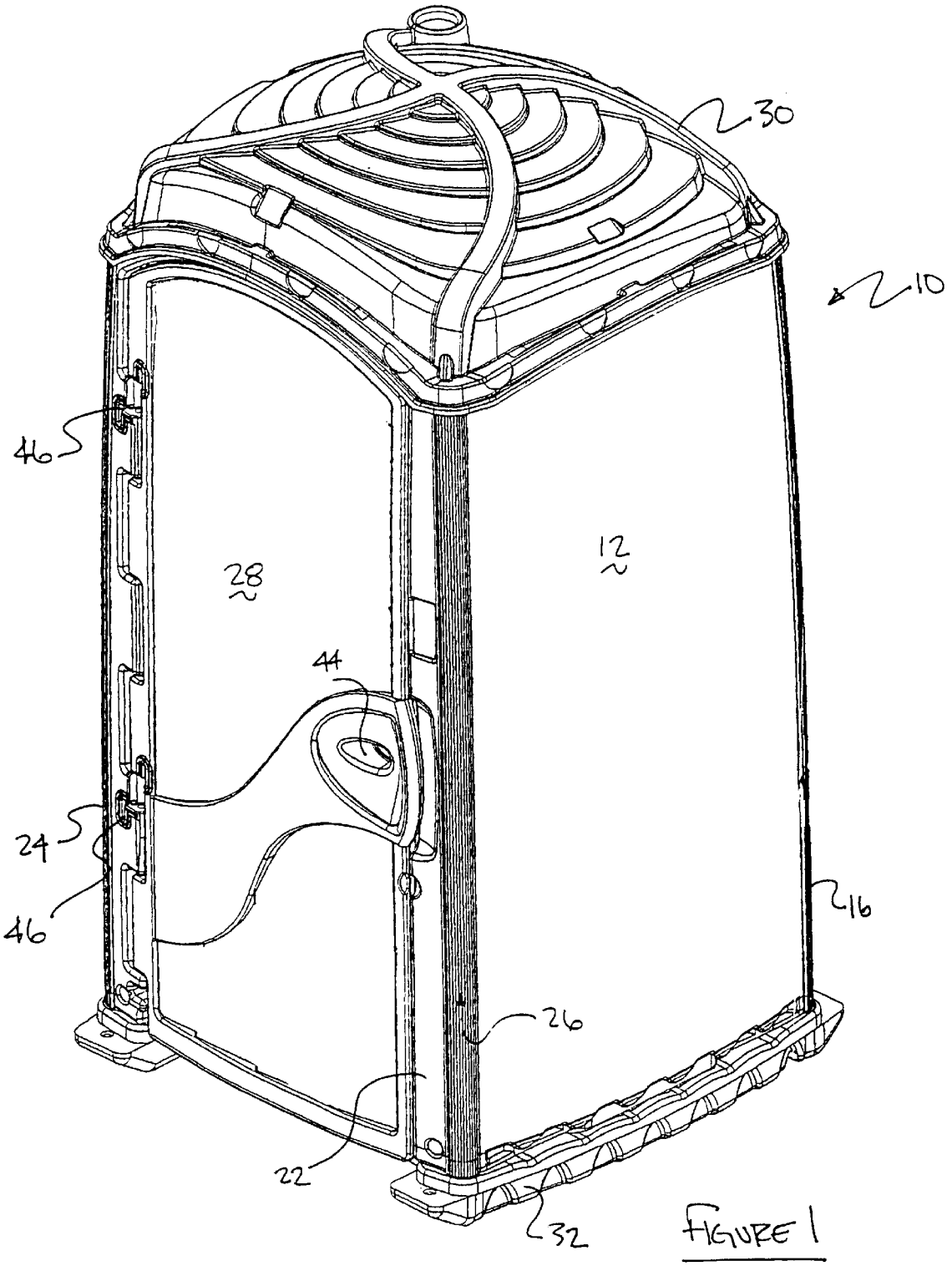
FIG. 1 is a perspective view of the portable restroom of the preferred embodiment of the invention.
Figure 2:
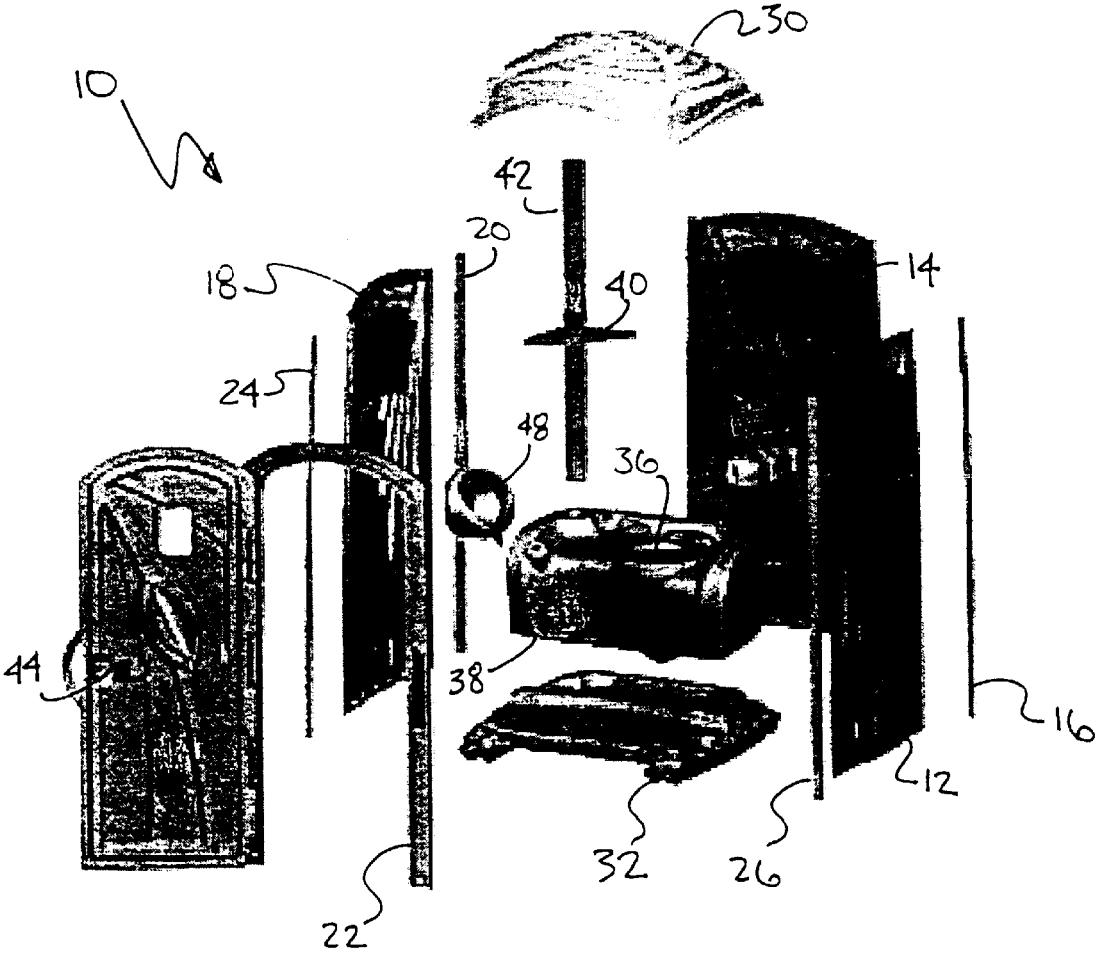
FIG. 2 is an exploded view of the portable restroom of FIG. 1.

As shown in FIGS. 1 and 2, the portable restroom 10 of the preferred embodiment includes a first panel 12, a second panel 14 connected to the first panel 12 with a first joint 16, a third panel 18 connected to the second panel 14 with a second joint 20, a door jam 22 connected to the third panel 18 with a third joint 24 and connected to the first panel 12 with a fourth joint 26, and a door panel 28 hinged to the door jam 22. The portable restroom 10 of the preferred embodiment also includes a roof 30 and a skid 32 both cooperating with the panels to define a private enclosure, a toilet 36 located within the private enclosure, and a tank 38 connected to the toilet 36. In some cases, the portable restroom 10 may include other suitable elements, such as a corner shelf 40, a vent pipe 42, and a door handle 44 with a locking mechanism, which are all known and used in the art of portable restrooms and could be integrated with the preferred embodiment by a person of ordinary skill.

The first panel 12, the second panel 14, the third panel 18, the door panel 28, the roof 30, and the skid 32 of the preferred embodiment function to define the private enclosure and to provide structural support for the portable restroom 10. Although shown with smooth surfaces, the panels may alternatively include ridges or corrugations, which may increase stiffness and aesthetics. Furthermore, although shown with a relatively planar shape, the panels may be curved to increase the interior space of the private enclosure. With a curvature, the portable restroom 10 may alternatively be arranged in a triangular pattern and provided without the third panel 18. Furthermore, although not preferred, the portable restroom 10 may alternatively be provided without the roof 30 or the skid 32.

The door jam 22 of the preferred embodiment functions to anchor the door panel 28 to the portable restroom 10 and to allow pivotal movement of the door panel 28 between an open position (shown in FIG. 2), which provide ingress and egress into and out of the private enclosure 34, and a closed position (shown in FIG. 1), which partially defines the private enclosure 34. The door jam 22 preferably includes a conventional hinge mechanism 46, but may alternatively include any other suitable device to allow movement of the door panel 28 between the open position and the closed position. The door jam 22 is preferably designed to bias the door into the closed position, but may alternatively be designed without any bias on the door panel 28.

The toilet 36 and the tank 38 of the preferred embodiment function to facilitate and contain human waste disposal. The toilet 36 is preferable located within the private enclosure 34 against the second panel 14 (opposite the door panel 28), but may alternatively be placed in any suitable location within the private enclosure 34. The toilet 36 may alternatively include a urinal 48 connected to the toilet 36 and located against the first panel 12 or the third panel 18. The tank 38 is preferably located beneath the toilet 36.

In the preferred embodiment, the portable restroom 10 is provided with four joints: the first joint 16 provides engagement to the first panel 12 and to the second panel 14, the second joint 20 provides engagement to the second panel 14 and to the third panel 18, the third joint 24 provides engagement to the third panel 18 and to the door jam 22, and the fourth joint 26 provides engagement to the door jam 22 and to the first panel 12. In alternative embodiments, the portable restroom 10 may be provided with only one joint to provide engagement between the first panel 12 and to the second panel 14 or may be provided with any suitable number of joints. If the portable restroom 10 is provided with multiple joints, the joints are preferably identical for manufacturing reasons, but may alternatively have minor differences.

Figure 3:
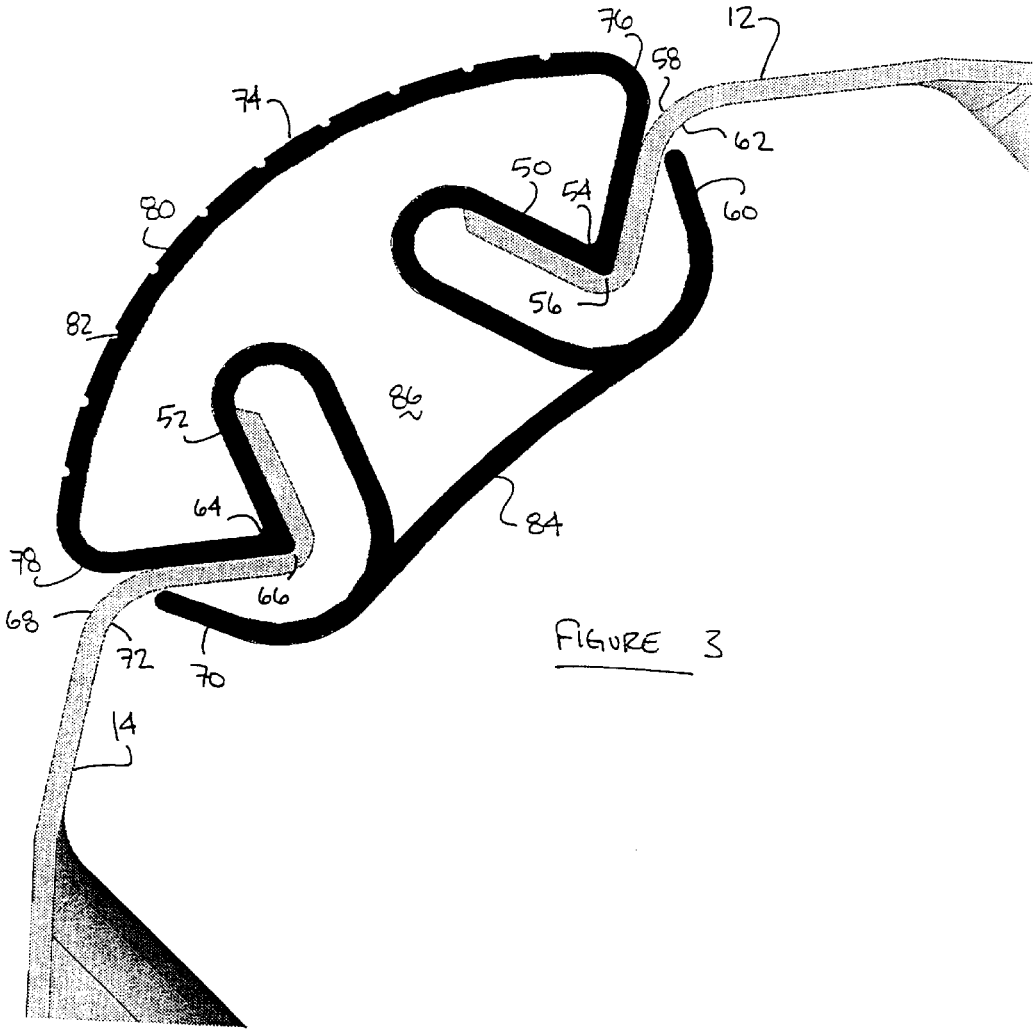
FIG. 3 is a cross-sectional view of the joint of the preferred embodiment, shown engaged to a first panel and a second panel.

As shown in FIG. 3, the joints of the preferred embodiment function to provide engagement to two panels with a first jaw section portion 50 and a second jaw section portion 52. The first jaw section 50 is adapted to allow insertion and removal of the first panel 12 along a first axis and to provide engagement to the first panel 12 in all directions perpendicular to the first axis. Similarly, the second jaw section 52 is adapted to allow insertion and removal of the second panel 14 along a second axis and to provide engagement to the second panel 14 in all directions perpendicular to the second axis. In other words, once assembled and erected in an upright position, the first jaw section 50 and the second jaw section 52 prevent the first panel 12 and the second panel 14 from accidentally disconnecting from, the joint. The joints preferably allow the panels to be slid relative to the joints and to eventually disconnect from the joints for the disassembly of the portable restroom.

Figure 4:
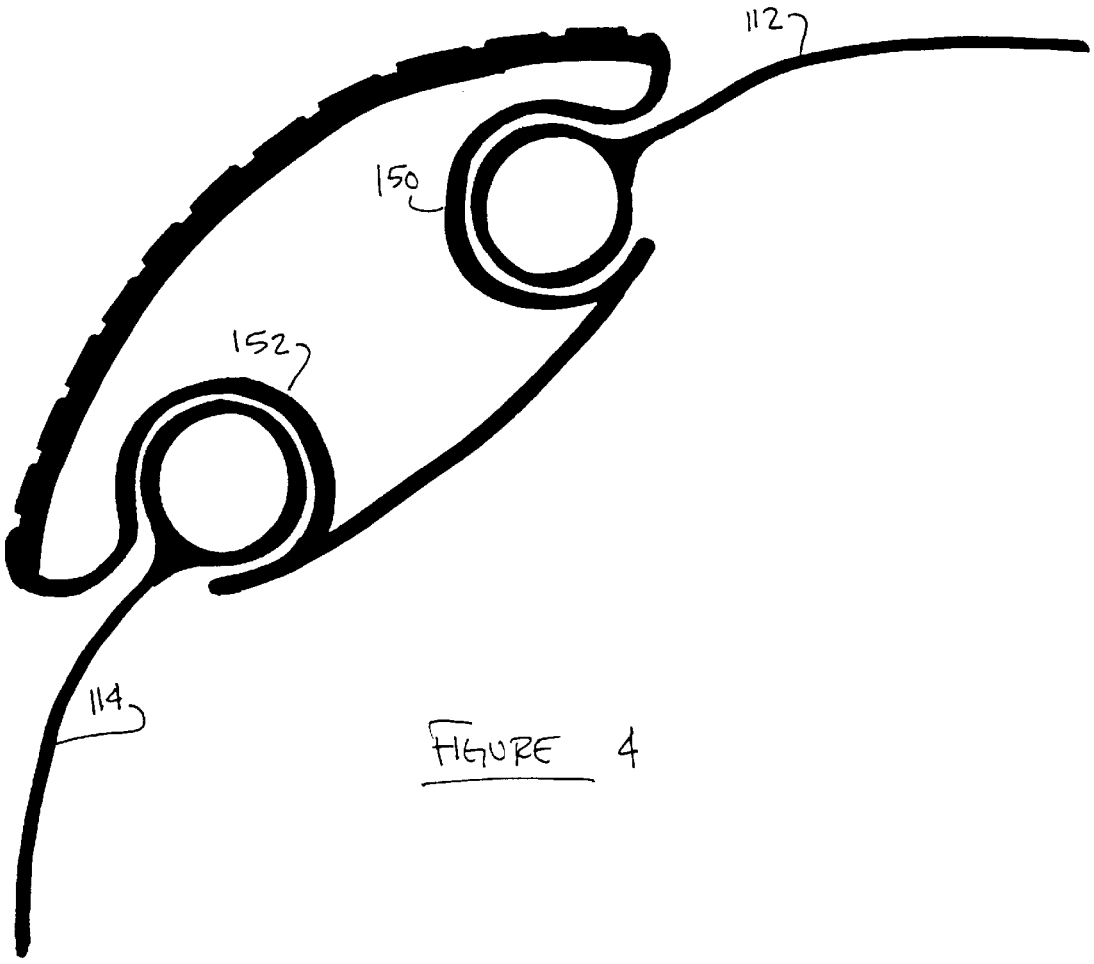
FIG. 4 is a cross-sectional view of a joint of an alternative embodiment of the invention.

In the preferred embodiment, the first jaw section 50 of the joint defines a first ridge 54 shaped to engage a first notch 56 in an outer surface 58 of the first panel 12 and a first wing 60 biased to engage an inner surface 62 of the first panel 12. Also, in the preferred embodiment, the second jaw section 52 defines a second ridge 64 shaped to engage a second notch 66 in an outer surface 68 of the second panel 14 and a second wing 70 biased to engage an inner surface 72 of the second panel 14. The ridges of the jaw sections and the notches of the panels are preferably "V" shaped, but may alternatively have any other suitable shapes that provide adequate engagement. The wings of the jaw sections are preferably designed to reach around the notches of the panels. In this manner, the ridges and the wings provide engagement to the panels. In an alternative embodiment (shown in FIG. 4), the first jaw section 150 and the second jaw section 152 may alternatively have other suitable shapes that provide adequate engagement to a modified first panel 112 and to a modified second panel 114.

The wings of the jaw sections of the preferred embodiment are designed to accommodate the insertion of a different panel with a different width, and to provide engagement to such panel. In this manner, the same joints may be supplied in a first line of portable restrooms with relatively thin panels and in a second line of portable restrooms with relatively thick panels. Such supply methodology allows for greater economies of scale for the manufacturing of the two separate lines of portable restrooms.

The joint of the preferred embodiment also includes an outer bumper section portion 74 having a first edge 76 connected to the first jaw section 50, a second edge 78 connected to the second jaw section 52, and a middle portion 80 located between the first edge 76 and the second edge 78. The outer bumper section 74 functions to provide support and protection for the first jaw section 50 and the second jaw section 52. For this reason, the outer bumper section 74 is preferably curved with a convex shape and located at a significant distance from the first jaw section 50 and the second jaw section 52. The outer bumper section 74 may alternatively include other suitable shapes and elements to provide support and protection for the first jaw section 50 and the second jaw section 52. The middle portion 80 of the joint preferably includes a non-smooth surface 82, which functions to hide scratches and mars of the joint caused during the transportation of the portable restroom. The non-smooth surface 82 may be provided during an extrusion process, with an etching process, or with any other suitable process or device. The middle portion 80 may alternatively include other suitable elements to hide scratches and mars of the joint.

The joint of the preferred embodiment also includes an inner support section 84 connected to the first jaw section 50 and the second jaw section 52 and located at a distance from the outer bumper member 74. The inner support section 84 functions to provide additional support to the joint. The joint may alternatively include internal trusses or other suitable devices to provide additional support. Preferably, the first jaw section 50, the second jaw section 52, the outer bumper section 74, and the inner support section 84 are initially formed as a unitary construction in the manufacturing process. Alternatively, the first jaw section 50, the second jaw section 52, the outer bumper section 74, and the inner support section 84 may be initially formed as separate pieces and then later joined as a uniform construction. The first jaw section 50, the second jaw section 52, the outer bumper section 74, and the inner support section 84, however, preferably cooperate to define an elongated tubular cavity 86.

Every part of the preferred embodiment is preferably made from an impact resistant plastic and with conventional manufacturing methods, but may alternatively be made from any suitable material and with any suitable manufacturing method. Furthermore, the joint of the preferred embodiment is preferably made with an extrusion process (which is known and used in the art of portable restrooms), but may alternatively be made with any suitable manufacturing process.

As a person skilled in the art of portable restrooms will recognize from the previous detailed description and from the figures and claims, modifications and changes can be made to the preferred embodiment without departing from the scope of this invention defined in the following claims.

We claim:

1. A joint for and a first panel and a second panel of a portable restroom, the combination comprising:

a first jaw portion adapted to allow insertion and removal of the first panel along a first axis, wherein the first jaw portion includes a first ridge shaped to engage a first notch in an outer surface of the first panel a second jaw portion adapted to allow insertion and removal of the second panel along a second axis, wherein the second jaw portion includes a second ridge shaped to engage a second notch in an outer surface of the second panel; and an outer bumper portion having a first edge connected to the first jaw portion and a second edge connected to the second jaw portion.

2. The joint of claim 1 wherein the first jaw portion includes a first wing biased to engage an inner surface of the first panel, and wherein the second jaw portion includes a second wing biased to engage an inner surface of the second panel.

3. The joint of claim 2 wherein the first wing allows insertion and removal of a third panel with a width different than the width of the first panel, and wherein the second wing allows insertion and removal of a fourth panel with a width different than the width of the second panel.

4. The joint of claim 1 wherein the outer bumper portion further includes a middle portion located between the first edge and the second edge and at a significant distance from the first jaw portion and the second jaw portion to provide protection to the first jaw portion and the second jaw portion.

5. The joint of claim 4 wherein the middle portion has a non-smooth surface.

6. The joint of claim 4 wherein the middle portion has a convex shape to absorb impact.

7. The joint of claim 1 further comprising an inner support portion connected to the first jaw portion and the second jaw portion and located at a distance from the outer bumper portion.

8. The joint of claim 7 wherein the first jaw portion, the second jaw portion, the outer bumper portion, and the inner support portion cooperate to define an elongated tubular cavity.

9. The claim 7 wherein the first jaw portion, the second jaw portion, the outer bumper portion, and the inner support portion of a unitary construction.

10. A portable restroom comprising:

a first panel;

a second panel;

a joint including a first jaw section adapted to allow insertion and removal of the first panel along a first axis, a second jaw section adapted to allow insertion and removal of the second panel along a second axis, and an outer bumper section having a first edge connected to the first jaw section and a second edge connected to the second jaw section, wherein the outer bumper section further includes a middle portion having a convex shape and located between the first edge and the second edge, at a predetermined distance to the first panel, and at a predetermined distance to the second panel;

a door jam connected to the first panel;

a door hinged to the door jam;

a roof cooperating with the first panel and the second panel to define a private enclosure;

a toilet located within the private enclosure; and a tank connected to the toilet.

11. The portable restroom of claim 10 wherein the first jaw section, the second jaw section, the outer bumper section, and the inner support section are initially made as a unitary construction.

12. The potable restroom of claim 10 wherein the first jaw section includes a first ridge shaped to engage a first notch in an outer surface of the first panel, and wherein the second jaw section includes a second ridge shaped to engage a second notch in an outer surface of the second panel.

13. The portable restroom of claim 12 wherein the first jaw section defines a first wing biased to engage an inner surface of the first panel, and wherein the second jaw section defines a second wing biased to engage an inner surface of the second panel.

14. The portable restroom of claim 13 wherein the first wing selectively allows engagement of the first panel with a different width, and wherein the second wing selectively allows engagement of the second panel with a different width.

15. The portable restroom of claim 10 wherein the middle portion has a non-smooth surface.

16. The portable restroom of claim 10 further comprising an inner support section connected to the first jaw section and the second jaw section and located at a distance from the outer bumper section.

17. The portable restroom of claim 16 wherein the first jaw section, the second jaw section, the outer bumper section, and the inner support section cooperate to define an elongated tubular cavity.

* * * * *

UNITED STATES PATENT AND TRADEMARK OFFICE

CERTIFICATE OF CORRECTION

PATENT NO. : 6,766,541 B2
DATED : July 27, 2004
INVENTOR(S) : Reginald E. Adams et al.

It is certified that error appears in the above-identified patent and that said Letters Patent is hereby corrected as shown below:

Column 4,
Line 14, after "A joint" delete "for".
Line 16, before "a first" insert -- the joint having --.
Line 20, before "a second" insert -- the joint further having --.
Line 56, before "claim 7" insert -- joint of --.

Signed and Sealed this

Ninth Day of November, 2004

JON W. DUDAS
*Director of the United States Patent and Trademark Office*